US005517693A

United States Patent [19]

Noonan

[11] Patent Number: 5,517,693

[45] Date of Patent: May 21, 1996

[54] HAND COVERING WITH PALM SLOT

[76] Inventor: Burke M Noonan, 1553 Highland Dr., Lake Oswego, Oreg. 97034

[21] Appl. No.: 352,610

[22] Filed: Dec. 9, 1994

[51] Int. Cl.[6] ..... A41D 19/00

[52] U.S. Cl. ..... 2/159; 2/161.1

[58] Field of Search ..... 2/158, 159, 161.1, 2/161.5, 161.6, 161.7, 164, 169, 16, 907, 917

[56] References Cited

U.S. PATENT DOCUMENTS

| | | | |
|---|---|---|---|
| 480,852 | 8/1892 | Kahn | 2/158 |
| 1,404,453 | 1/1922 | Lynn | 2/158 |
| 1,849,418 | 3/1932 | Chesebro . | |
| 2,274,335 | 2/1942 | Kennedy . | |
| 2,323,136 | 6/1943 | Johanson . | |
| 2,451,837 | 10/1948 | La Londe et al. . | |
| 3,299,441 | 1/1967 | Slimovitz . | |
| 4,704,743 | 11/1987 | Thornell et al. | 2/159 |
| 4,791,683 | 12/1988 | Agee . | |
| 5,444,874 | 8/1995 | Samelian et al. | 2/159 |

FOREIGN PATENT DOCUMENTS

| | | | |
|---|---|---|---|
| 165805 | 2/1934 | Switzerland | 2/158 |

*Primary Examiner*—Michael A. Neas
*Attorney, Agent, or Firm*—Kolisch Hartwell Dickinson McCormack & Heuser

[57] ABSTRACT

A glove is provided having a slot in a palmar region disposed over a wearer's palm with edges that may be selectively joined to close the slot or parted to open the slot. The slot has a generally L-shaped course extending from a proximal end of the palmar portion, forward to a distal end of the palmar portion and then tranversely to an ulnar edge of the palmar portion. When the slot is open, a wearer's fingers and thumb may be extended therethrough without removing the glove. The L-shaped course and location of the slot make it easy to extend and replace the wearer's fingers and thumb with only minimal readjustment of the glove.

10 Claims, 1 Drawing Sheet

HAND COVERING WITH PALM SLOT

TECHNICAL FIELD

This invention relates generally to hand coverings, and more particularly to a glove having a slot across it's palm through which a wearer's thumb and forefingers may be extended.

BACKGROUND

Gloves and mittens are commonly worn to protect a wearer's hands while engaging in cold weather outdoor activities such as skiing, and are, of necessity, somewhat bulky. Because of the cumbersome nature of most gloves and mittens, it is often difficult to make fine manual or digital manipulations, such as working zippers, applying ski lift tickets or handling/eating food, without removing the gloves or mittens. Numerous variations on the basic glove/mitten design have been fashioned to deal with this problem, but none have fully addressed the problems at hand.

U.S. Pat. No. 1,849,418 to Chesebro teaches a mitten for hunters which incorporates a linear finger slot across the palm portion of the mitten adjacent the junction of the wearer's palm and fingers. The wearer's fingers can be extended through the slot to provide some improvement to the wearer's ability to control a gun or fishing rod.

U.S. Pat. No. 3,299,441 to Slimovitz describes another mitten with a linear finger slot wherein a flexible flap covers the slot. One edge of the flap is stitched to the mitten and the other edge is releasably secured in place using a Velcro™ hook and loop fastener arrangement.

U.S. Pat. No. 2,323,136 to Johanson discloses a mitten for hunters and soldiers which includes a separated forefinger enclosure and a hood. The hood normally covers all of the fingers, including the forefinger, as in a standard mitten, but can be folded back to expose the separated forefinger enclosure. The mitten further includes a transverse slot in the wrist portion through which the entire hand can be passed, exposing the hand but leaving a ring of material still securing the mitten to the wearer. Use of the transverse slot provides a convenient way to keep the mittens handy when they are not being worn.

While all of the previously described hand coverings provide some amount of increased dexterity, none afford the adroitness possible with both the thumb and fingers exposed. It will be appreciated, however, that many tasks such as tying shoes or boots, reloading a gun, or writing, are much easier if both the thumb and fingers can be used without the impediment of an intervening glove. In each of the previously described mittens, only the wearer's fingers may be exposed, the wearer's thumb remaining trapped in the mitten. This is unacceptable. Simply removing the gloves to perform precision tasks similarly is unacceptable because it would leave the hands completely exposed to the elements. Also, the wearer would have to somehow hold, or find someplace to set, the removed gloves to free his or her hands. In addition, putting the gloves back on can be an awkward process, especially with the second glove.

Accordingly, it is an object of the present invention to provide a hand covering which allows the wearer to selectively expose both thumb and fingers while still providing warmth to the wearer's hand.

It is another object of this invention to provide a hand covering from which the wearer's fingers and thumb can easily be exposed when necessary and recovered without significant effort.

SUMMARY

The present invention achieves the above objectives by providing a glove having a slot in a palmar region with edges that may selectively be joined to close the slot or parted to open the slot. The slot has a generally L-shaped course extending from a proximal end of the palmar region adjacent a thumb portion, forward to a distal end of the palmar region and then transversely to an ulnar side of the palmar region. When the slot is open, a wearer's fingers and thumb may be extended therethrough without removing the glove. The L-shaped course and location of the slot make it easy to extend and replace the wearer's fingers and thumb with minimal readjustment of the glove. Also, due to the relative stiffness of the material of which it is constructed, the glove provides some residual protection from the elements by covering the back of the wearer's hand and a portion of the palm, even when the fingers and thumb are extended through the slot.

DETAILED DESCRIPTION OF THE PREFERRED EMBODIMENT

Figure 1:
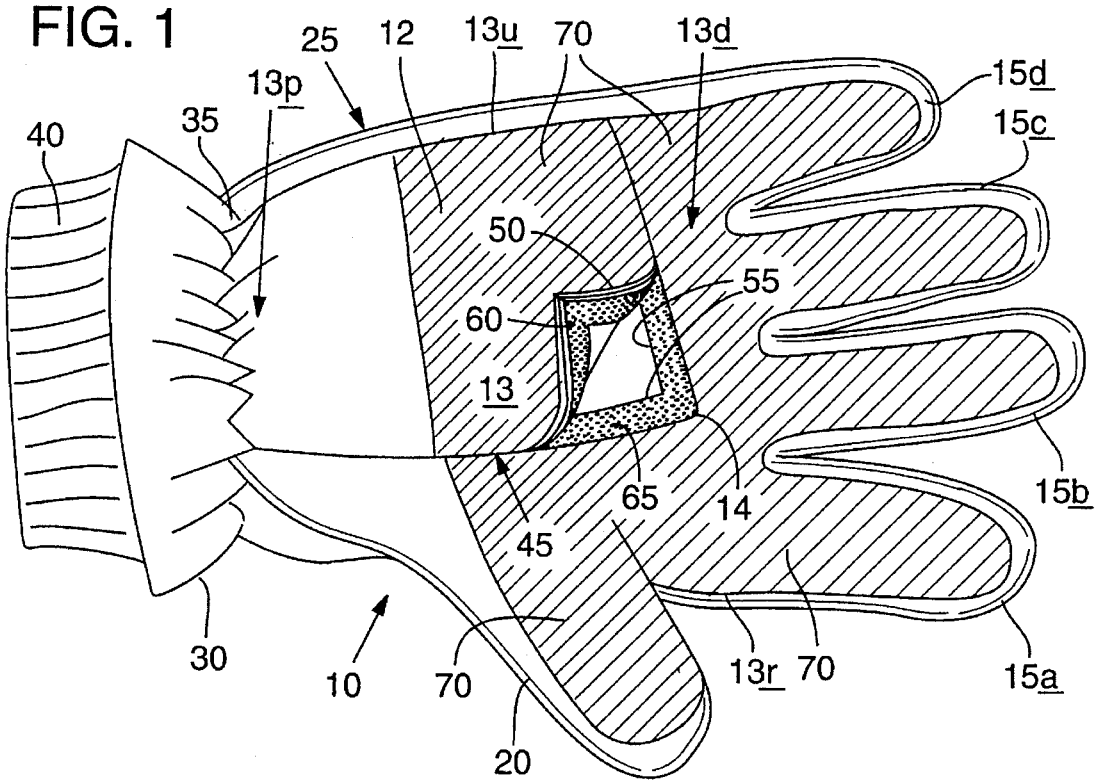
FIG. 1 is a palm-side view of a glove formed according to a preferred embodiment of the present invention, with a corner of an otherwise sealed slot having been folded back.

A hand covering in the form of a glove constructed according to the present invention is shown at 10 in FIG. 1. The glove is preferably constructed of a durable water resistant shell, such as Nylon™ or Gore-Tex™, and an insulative liner, such as Thinsulate™ or polyester. A leather-like reinforcement 70 may cover the gripping portions of the palm side of glove 10 to provide additional wear resistance. The glove is preferably stitched together from appropriately shaped component pieces to form a rugged, thermally insulating, unitary body which substantially protects the wearer's hands from cold, and possibly wet weather.

Glove 10 includes a palm portion 12, finger portions 15, a thumb portion 20 and a wrist portion 30. Finger portions 15 include forefinger portion 15*a*, middle finger portion 15*b*, ring finger portion 15*c* and little finger portion 15*d*, which are each joined to and extend from palm portion 12. Thumb portion 20, and wrist portion 30 are also joined to and extend from palm portion 12. Palm portion 12 includes a palmar region 13 disposed over the wearer's palm. Palmar region 13 is joined to finger portions 15 at a distal end 13*d*, to thumb portion 20 at a radial side 13*r*, and to wrist portion 30 at a proximal end 13*p*. Palmar region 13 also includes an ulnar side 13*u* disposed opposite to radial side 13*r*.

Thumb, finger and palm portions 20, 15, 12 combine to define a hollow hand portion 25. Hand portion 25 extends about a wearer's palm, and extends back to the wrist portion 30 which covers the wearer's wrist. Finger, thumb, palm, and wrist portions 15, 20, 12, 30 (respectively), collectively form a continuous enclosure to envelope the wearer's hand up to the wrist. An elastic band 35 is included in wrist portion 30 to help secure and seal glove 10 in place by creating a constriction in wrist portion 30 to grip the wearer's wrist. A knit tube portion 40 extends up the wearer's arm from wrist portion 30 and is sufficiently compliant to conform to the wearer's arm, thereby providing resistance to entry of snow or other foreign matter, as well as cold air.

Figure 2:
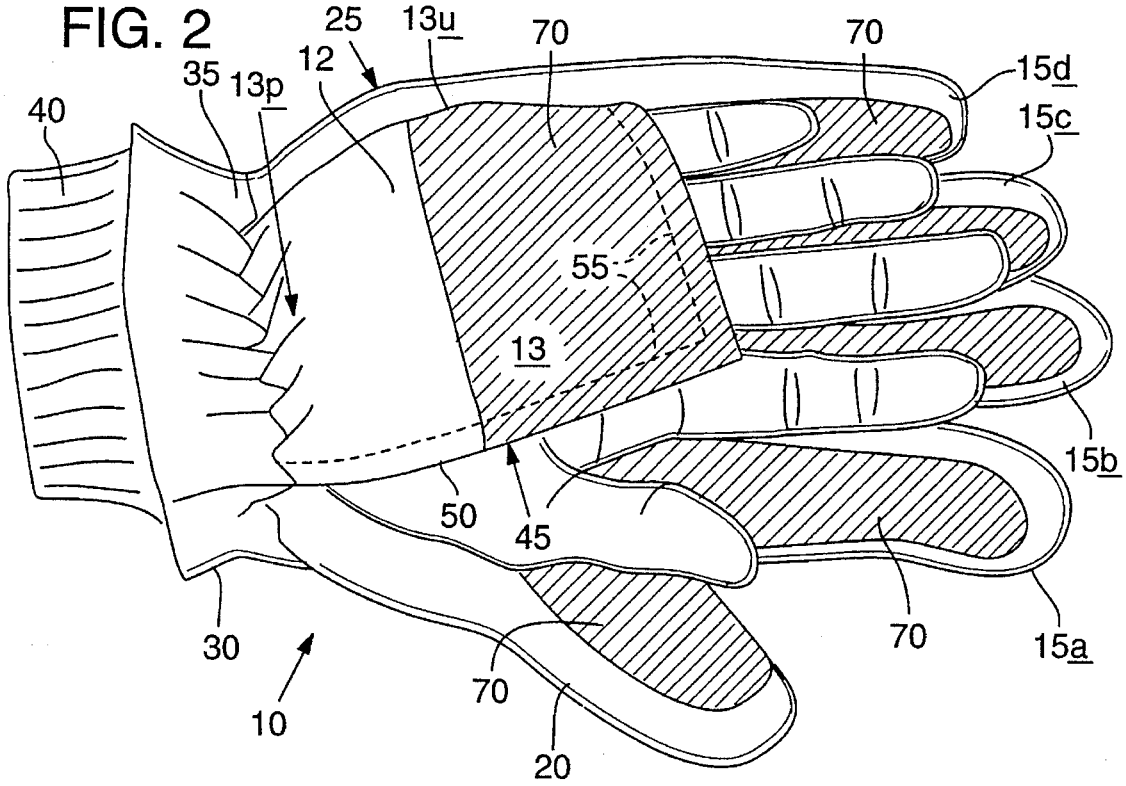
FIG. 2 is a palm-side view of the glove of FIG. 1, but showing the fingers and thumb extended through the fully open slot.

A slot 45 in palmar region 13 of palm portion 12 begins at proximal end 13*p* near radial side 13*r* and extends forwardly to a point such as slot corner 14 situated on distal end 13*d* roughly midway between ulnar and radial sides 13*u*, 13*r*. Slot 45 continues from slot corner 14 transversely along distal end 13*d* to terminate near ulnar edge 13*u*. Slot 45 is bounded by a first edge 50 and a second edge 55 which may selectively be joined to close slot 45 or parted to open slot 45. When edges 50 and 55 are joined, glove 10 works essentially like any other glove to provide protection from the elements. However, with edges 50 and 55 parted, the wearer's fingers and thumb may be extended through slot 45, thereby permitting the precise manipulations required for some tasks. See FIG. 2.

So that the wearer's thumb can be extracted with relative ease and have sufficient room to move freely, it is important that slot 45 start at or near the radial side of proximal end 13*p*. Similarly, slot 45 must extend forwardly from proximal end 13*p* to distal end 13*d*, and transversely substantially thereacross to facilitate removal and reinsertion of the wearer's fingers and thumb. This slot configuration and use of the preferred construction materials, as described above, results in glove 10 with the relative stiffness necessary to cause the glove to remain close to the hand, even when the fingers and thumb are extended through slot 45.

Edges 50, 55 of slot 45 are joined by opposed strips of hook material 60 and loop material 65, together comprising a Velcro™ fastener arrangement running along edges 50 and 55. In particular, a strip of hook material 60 is sewn along substantially the entire length of edge 50 and an opposed strip of loop material 65 is sewn along substantially the entire length of edge 55. When pressed together, hook and loop materials 60 and 65 reversibly close slot 45. Slot 45 can be reopened by simply separating hook and loop materials 60 and 65 again.

Another embodiment of the present invention comprises the same features previously described except that finger portion 15*a–d* are unified into a single finger portion, thereby forming a mitten (not shown).

While the present invention has been shown and described with reference to the foregoing operational principles and preferred embodiment, it will be apparent to those skilled in the art that various changes in form and detail may be made without departing from the spirit and scope of the invention as defined by the claims.

I claim:

1. In a hand covering formed of a flexible insulative material including at least one finger portion, a thumb portion, a wrist portion and a palm portion including a palmar region, where a distal end of the palmar region is joined to the at least one finger portion, a proximal end of the palmar region is joined to the wrist portion, a radial side of the palmar region is joined to the thumb portion and an ulnar side is disposed opposite the radial side, the improvement comprising:

a slot formed in the palmar region consisting of a first slot section extending in a substantially straight line from the proximal end to a point on the distal end substantially midway between the radial and ulnar sides and a second slot section continuing transversely along the distal end to the ulnar side of the palmar portion, the slot further including selectively joinable or partable first and second edges and being sized so as to allow the wearer's fingers and thumb to be extended therethrough when the edges are parted.

2. The hand covering of claim 1, wherein the slot has a course generally in the shape of an L.

3. The hand covering of claim 1, wherein the first and second edges include cooperating strips of hook and loop fastener material joined to the first and second edges, respectively, so that the edges may be joined by pushing them together and parted by pulling the them apart.

4. The hand covering of claim 1, wherein there are four finger portions.

5. In a hand covering formed of a flexible water resistant insulative material designed to cover a wearer's hand and including at least one finger portion, a thumb portion, a wrist portion and a palm portion including a palmar region, where a distal end of the palmar region is joined to the at least one finger portion, a proximal end of the palmar region is joined to the wrist portion, a radial side of the palmar region is joined to the thumb portion and an ulnar side is disposed opposite the radial side, the improvement comprising:

an slot disposed in the palmar region, the slot consisting of a first end located adjacent to the proximal end near the radial side and a second end located adjacent to the distal end near the ulnar side and a slot section extending between and terminating at the ends, the slot being sized so that the wearer's fingers and thumb can be extended therethrough without substantial readjustment of the hand covering on the wearer's hand.

6. The hand covering of claim 5 wherein the slot selectively is openable and closeable using cooperating strips of hook and loop fastener.

7. The hand covering of claim 6 wherein the slot traverses a generally L-shaped course.

8. A hand covering formed of a flexible insulative material designed to cover a wearer's hand, the hand covering comprising:

at least one finger portion;

a thumb portion;

a wrist portion;

a palm portion including a palmar region, where a distal end of the palmar region is joined to the at least one finger portion, a proximal end of the palmar region is joined to the wrist portion, a radial side of the palmar region is joined to the thumb portion and an ulnar side is disposed opposite the radial side; and a slot in the palmar region consisting of a first slot section beginning at and extending substantially directly from a point on the proximal end to a point on the distal end roughly midway between the radial and ulnar sides and a second slot section continuing transversely along the distal end to terminate at the ulnar side, the slot including first and second edges which selectively may be joined or parted and further being sized so that the wearer's fingers and thumb may be retractably extended through the slot when the edges are parted.

9. The invention of claim 8 wherein the slot traverses a generally L-shaped course.

10. The invention of claim 9 further comprising strips of cooperating hook and loop fastener material, the strip of hook material being fastened to the first edge and the strip of loop material being hooked to the second edge, both strips disposed along substantially the entire length of the edges, whereby the edges may be joined by pushing the strips together and parted by pulling the strips apart.

* * * * *